US010376751B2

(12) United States Patent
Batista et al.

(10) Patent No.: US 10,376,751 B2
(45) Date of Patent: Aug. 13, 2019

(54) TELESCOPIC GOLF BALL PICKER UPPER

(71) Applicants: Antonio Batista, Hartford, CT (US); Jose Batista, Windsor, CT (US)

(72) Inventors: Antonio Batista, Hartford, CT (US); Jose Batista, Windsor, CT (US)

( * ) Notice: Subject to any disclaimer, the term of this patent is extended or adjusted under 35 U.S.C. 154(b) by 0 days.

(21) Appl. No.: 16/059,800

(22) Filed: Aug. 9, 2018

(65) Prior Publication Data

US 2018/0345087 A1 Dec. 6, 2018

Related U.S. Application Data

(63) Continuation-in-part of application No. 15/612,114, filed on Jun. 2, 2017, now abandoned.

(51) Int. Cl.
*A63B 47/02* (2006.01)
*A63B 57/00* (2015.01)

(52) U.S. Cl.
CPC ..... *A63B 47/02* (2013.01); *A63B 57/00* (2013.01); *A63B 2225/09* (2013.01)

(58) Field of Classification Search
CPC ..... A63B 47/02; A63B 57/00; A63B 2225/09
USPC ..... 294/19.2
See application file for complete search history.

(56) References Cited

U.S. PATENT DOCUMENTS 2,760,807 A * 8/1956 Watson ..... A63B 47/02 294/19.2
2,968,509 A * 1/1961 Borah ..... A63B 47/02 294/19.2
3,442,544 A * 5/1969 Faber ..... A63B 47/02 294/19.2
3,901,545 A * 8/1975 Shott ..... A63B 47/02 294/19.2
4,522,438 A * 6/1985 Logue ..... A63B 47/02 221/306
4,659,125 A * 4/1987 Chuan ..... A63B 47/02 16/429
5,188,410 A * 2/1993 Summers ..... A63B 47/02 294/19.2
5,328,174 A * 7/1994 Reeder ..... A63B 47/02 473/239
5,437,488 A * 8/1995 Richmond ..... A63B 47/02 294/19.2
5,505,510 A * 4/1996 Duncan ..... A63B 47/02 294/19.2
7,178,844 B2 * 2/2007 Evilsizer ..... A63B 47/02 294/19.2
2005/0077741 A1 * 4/2005 Light ..... A63B 47/02 294/19.2

(Continued)

FOREIGN PATENT DOCUMENTS

FR 1429211 * 2/1966

*Primary Examiner* — Dean J Kramer
(74) *Attorney, Agent, or Firm* — Furr Law Firm; Jeffrey Furr, Esq.

(57) ABSTRACT

The current invention is a golf ball retriever that enables an individual to pick up a golf ball without requiring the user to bend over. The golf ball retriever includes an extendable rod with a cup configured to receive a golf ball disposed at a distal end of the rod. In one embodiment, the extendable rod is in a telescopic arrangement movable between an extend position and a retracted position. In use, the rod is extended and the cup is pressed over the ball. The cup receives the ball, and the ball remains within the cup until removed by a user.

2 Claims, 6 Drawing Sheets

(56) References Cited

U.S. PATENT DOCUMENTS

| | | | | |
|---|---|---|---|---|
| 2006/0055189 | A1* | 3/2006 | Dalsing | A63B 57/00 294/19.2 |
| 2011/0053701 | A1* | 3/2011 | Eddings | A63B 57/00 473/286 |

* cited by examiner

TELESCOPIC GOLF BALL PICKER UPPER

CROSS-REFERENCES TO RELATED APPLICATIONS (IF ANY)

This application it's a continuation-in-part of application Ser. No. 15/612,114 filed on Jun. 2, 2017, which is incorporated by reference.

BACKGROUND

1. Field of the Invention

This invention relates to improvements in golf ball retrievers.

2. Description of Prior Art

After sinking a putt, a golfer then has to bend over or kneel down in order to retrieve their ball from the hole. For a golfer with bad knees or a sore back, recovering the ball can be difficult. Further, it takes unwanted time and energy to bend down and pick up the ball. Some players may have to ask others to retrieve their ball for them. However, a more convenient method is needed. There exists a need for a device that can retrieve the golf ball from the ground without requiring the golfer to bend down.

There is still room for improvement in the art.

SUMMARY OF THE INVENTION

The present invention provides a golf ball retriever that enables an individual to pick up a golf ball without requiring the user to bend over. The golf ball retriever includes an extendable rod with a cup configured to receive a golf ball disposed at a distal end of the rod. In one embodiment, the extendable rod is in a telescopic arrangement movable between an extend position and a retracted position. In use, the rod is extended and the cup is pressed over the ball. The cup receives the ball, and the ball remains within the cup until removed by a user. The cup will have a multiple sets of inner lips that serve to hold the golf ball in place.

BRIEF DESCRIPTION OF THE DRAWINGS

Without restricting the full scope of this invention, the preferred form of this invention is illustrated in the following drawings.

DESCRIPTION OF THE PREFERRED EMBODIMENT

Figure 1:
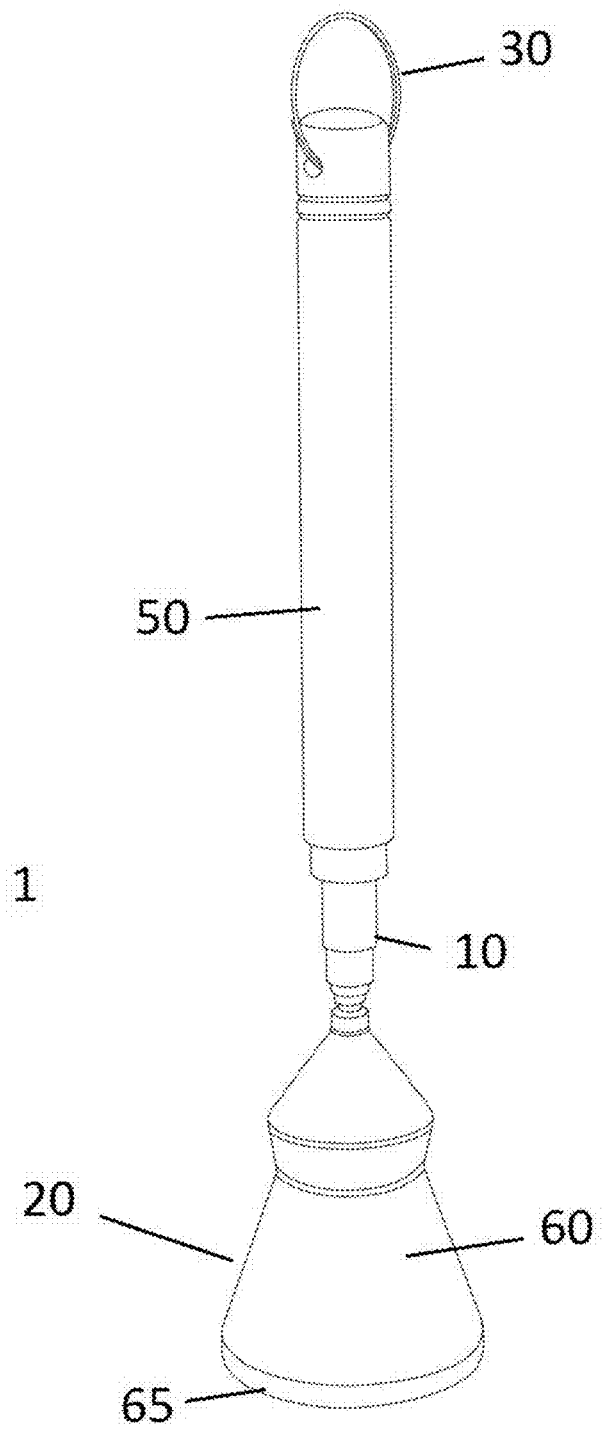
FIG. 1 shows a side view of one embodiment of the present invention in a re-tracked position.

There are a number of significant design features and improvements incorporated within the invention.

The current invention is golf ball retriever 1 that can be used with various poles of multiple diameters.

Referring now to FIGS. 1 through 4 there is a shown side view of one embodiment of the present invention. The present invention provides a golf ball retriever 1 that enables an individual to pick up a golf ball without requiring the user to bend over. The golf ball retriever 1 comprises an extendable rod 10 having a cup 20 configured to receive a golf ball disposed at a distal end of the rod 10. At the opposing end of the rod, a handle 50 for gripping the present invention. In one embodiment, the handle 50 includes padding concentric with the rod and a key ring 30.

Figure 2:
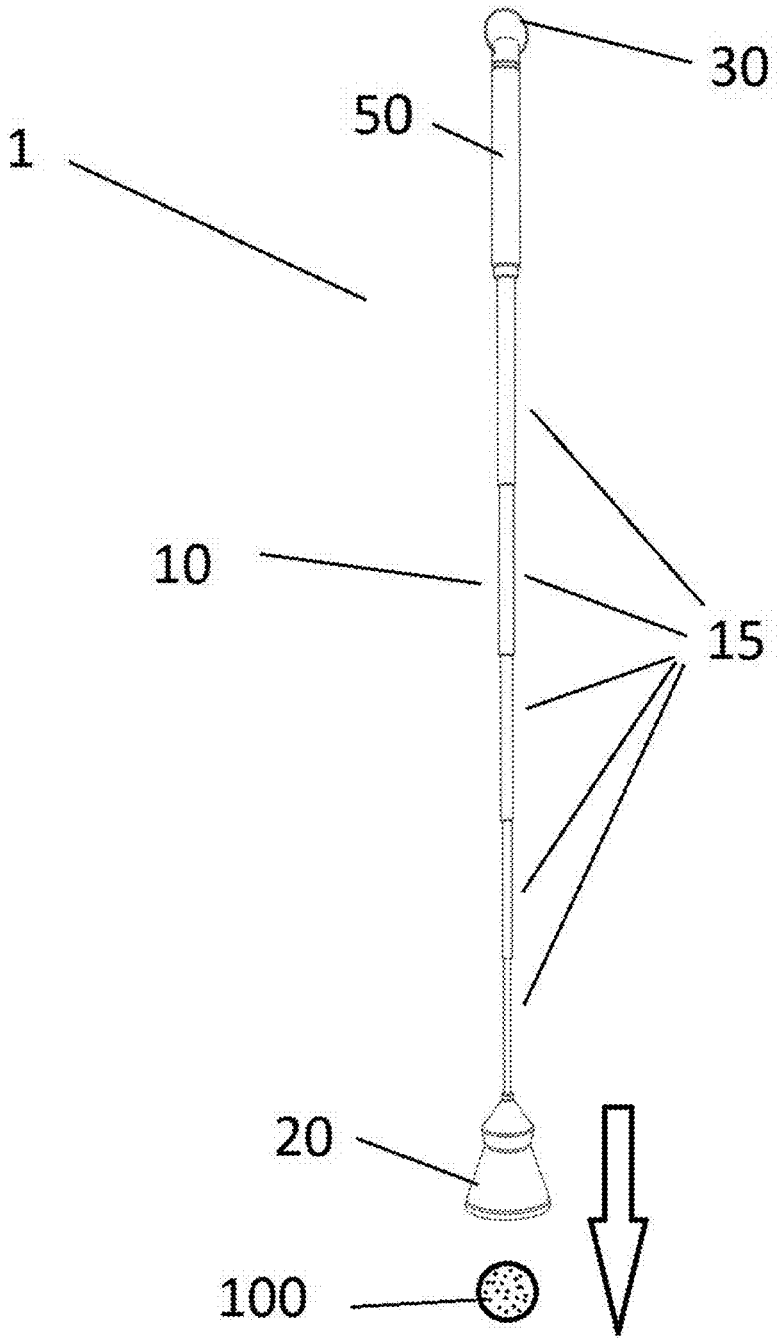
FIG. 2 shows a side view of one embodiment of the present invention in an extended position ready to pick up a golf ball.
Figure 4:
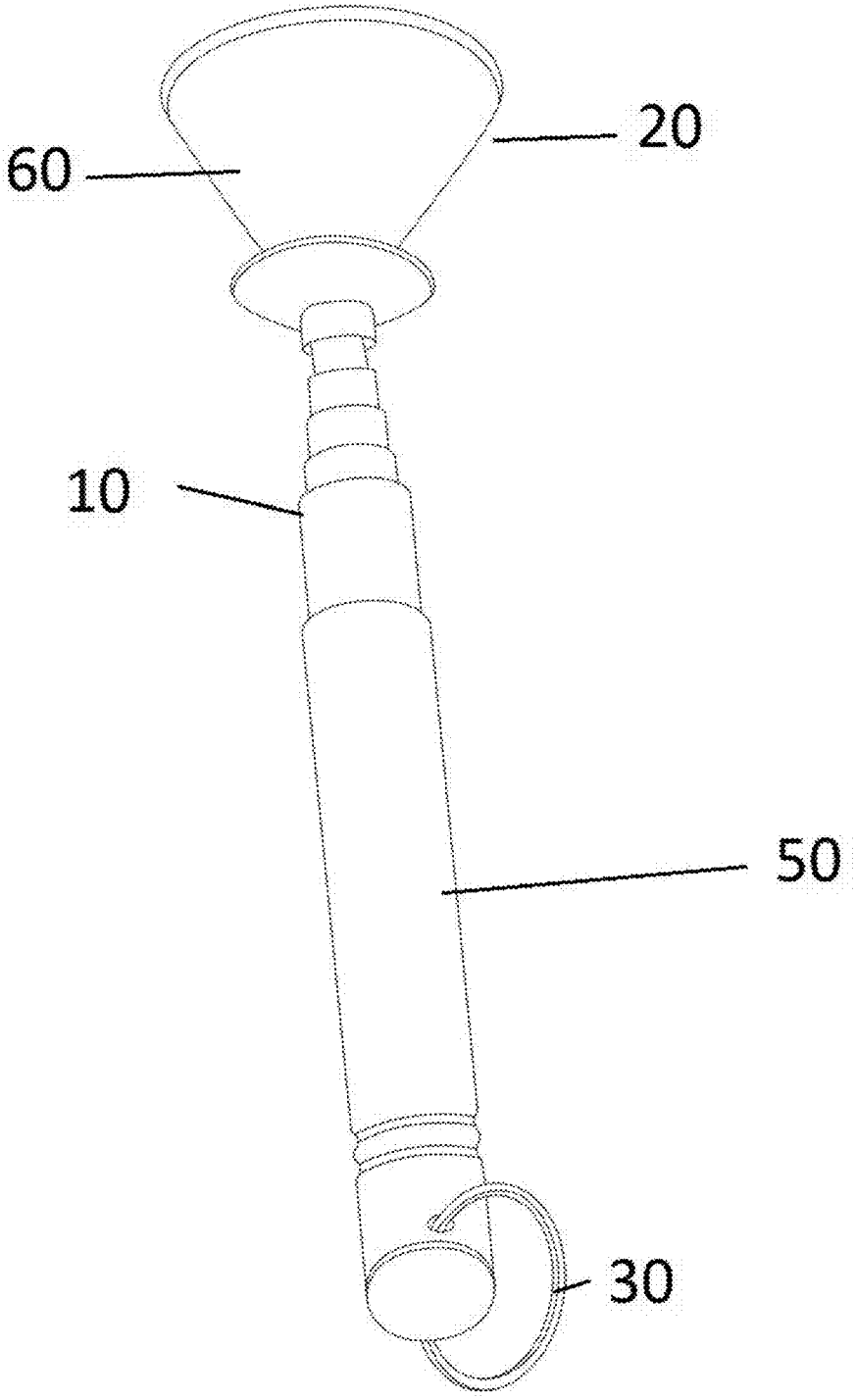
FIG. 4 shows a side perspective view of one embodiment of the present invention in a re-tracked position.

Referring now to FIGS. 1, 2, and 4, there is a shown side view of one embodiment of the present invention in a retracted position and an extended position, respectfully. In one embodiment, the extendable rod 10 is in a telescopic arrangement movable between an extend position and a retracted position. The extendable rod 10 includes one or more elongated sections 15 adjustably secured to each other so as to allow the rod 10 to extend into the extended position and retract into a retracted position. This telescopic arrangement of the elongated sections 15 provides for adjustment of the linear length of the rod 10. The elongated sections 15 may be frictionally engaged with each other, or fastened to one another via any suitable fastener.

Figure 3:
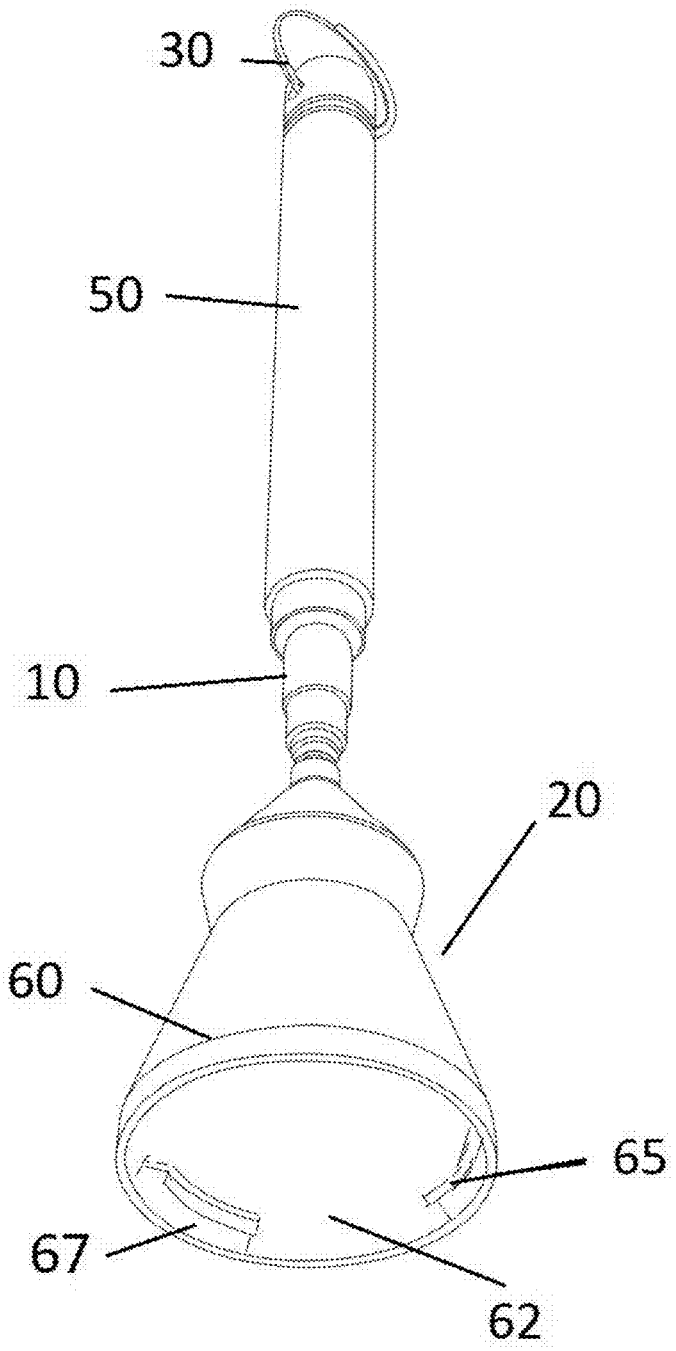
FIG. 3 shows a close-up view of the underside of one embodiment of the cup of the present invention.
Figure 5:
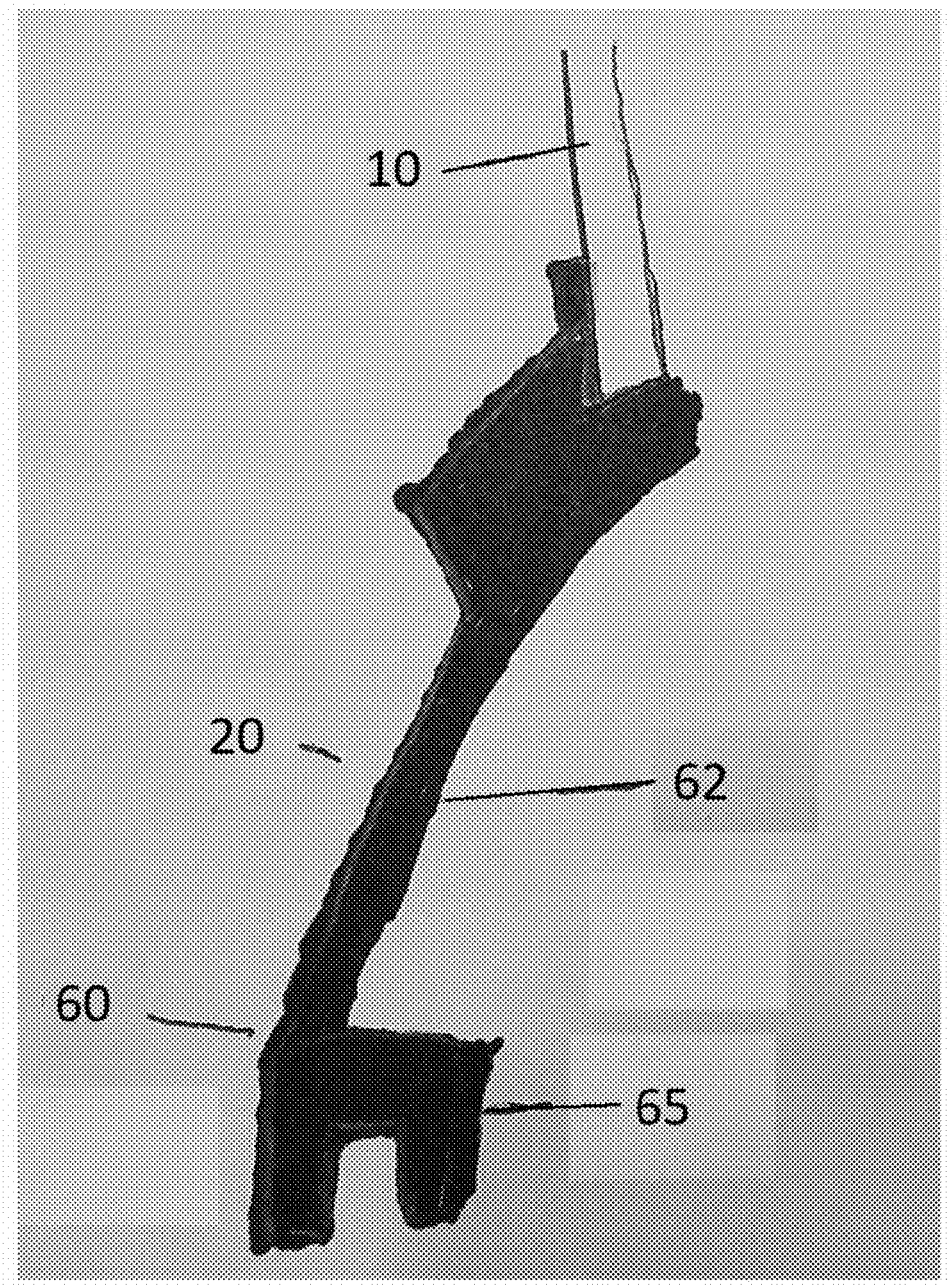
FIG. 5 shows a cut out view of the inner lip of the cup.

Referring now to FIGS. 3 and 5, there is an up view of the underside of one embodiment of the cup 20 of the present invention and a perspective view of one embodiment of the present invention, respectfully. The cup 20 is dimensioned for receiving a golf ball 100 therein and includes a sidewall 60 that tapers from a first end towards an opposing second end, wherein the first end is affixed to the rod 10 and the second end is an open lower end 62 for receiving the gold ball 100. The second end further includes a set of multiple first ball-stopping perimeter inner lips 65 and a secondary perimeter lip thereon sized and shaped for securing the ball 100 within the cup 20 after insertion. Each set of inner lips 65 form an inner lips structure 67. In the preferred embodiment, there are three evenly spaces inner lip structures 67 with breaks in between the inner lip structures 67 so that the inner lips 65 do not go completely around the circumference of the inner cup 20.

As shown in FIG. 2, the rod 10 is used to place the cup 20 over the golf ball 100 to retrieve it. The cup 20 is positioned over the ball 100 and moved such that the cup 20 receives the ball 100 therein. The ball 100 remains within the cup 20, through frictional engagement or pressure differential, until a user removes the ball therefrom. As shown in FIG. 5, the inner lips 65 inner lip 65 extends out from the sidewall 60 forming a ledge and then is angled down at slight inward angle forming an edge. The edge that extends downward which compresses when a ball 100 is retrieved allowing the ball 100 to enter the cup 20 and be held in place by the ledge of the inner lips 65. The inner lips 65 are made of a compressible material like plastic or rubber and thin metal.

Figure 6:
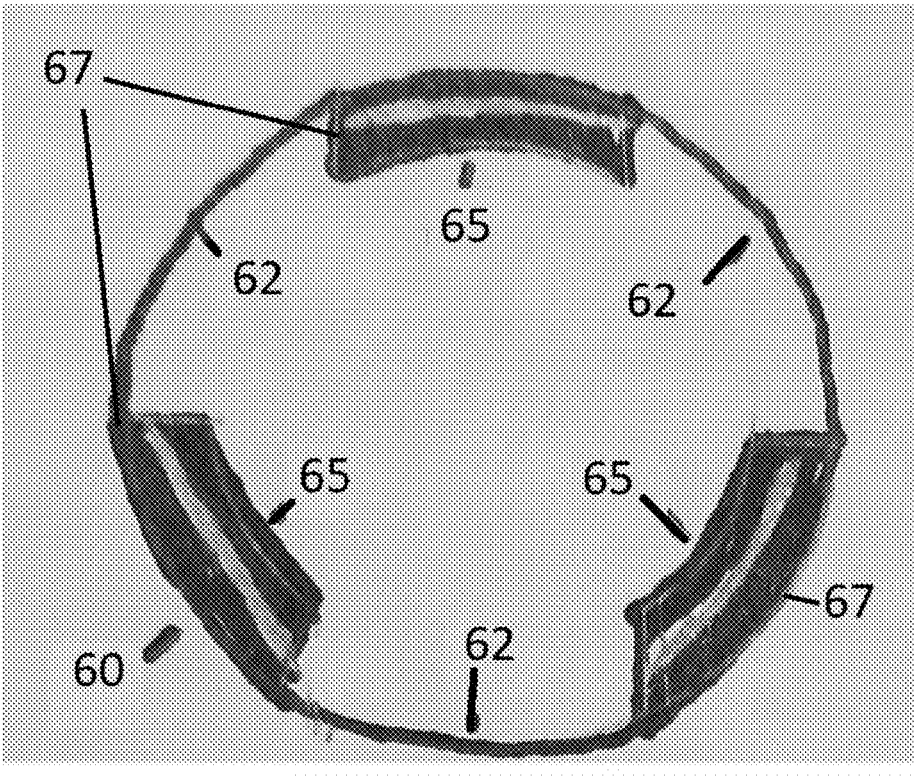
FIG. 6 shows the view of the bottom of the cup showing the inner lip structures.

As shown in FIG. 6, the inner lips structures 67 are spaced out making the receiving of the ball 100 into the cup 20 easier and more efficient while also making the removal of the ball 100 easier based on the spacing of the inner lip structures 67. A user can better grab the ball and work against just the compression force of one of the inner lip structure 67 to easily remove the ball 100.

Advantages

The innovative golf ball retrieving rod removes the need for a golfer to bend down to get their golf ball reducing back and knee stress.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

That which is claimed is:

1. A golf ball retrieving device comprising:

a telescoping rod with a top end and a bottom end with a handle at the top end and a cup on the bottom end where the rod has elongated sections and where the cup has a sidewall that tapers from a first end towards an opposing second end wherein the first end is affixed to the rod and the second end is an open lower end for receiving a golf ball and where the second end further includes a plurality of inner lip structures formed by an inner lip extending away from the side wall of the cup toward the center of the cup and then downwardly at an angle where the inner lip structures are L-shaped in cross-section.

2. The device according to claim 1 further comprising:

where the cup is dimensioned for receiving a golf ball.

* * * * *